United States Patent [19]

Olsson

[11] 4,348,859

[45] Sep. 14, 1982

[54] METHOD AND APPARATUS FOR THE PRODUCTION OF FANCY YARN

[76] Inventor: Per O. Olsson, Bruksgatan, S-312 02 Laholm, Sweden

[21] Appl. No.: 143,584

[22] PCT Filed: Jan. 9, 1979

[86] PCT No.: PCT/SE79/00002

§ 371 Date: Sep. 5, 1979

§ 102(e) Date: Sep. 5, 1979

[87] PCT Pub. No.: WO79/00489

PCT Pub. Date: Jul. 26, 1979

[30] Foreign Application Priority Data

Jan. 10, 1978 [SE] Sweden ..... 7800246

[51] Int. Cl.[3] ..... D01H 1/12

[52] U.S. Cl. ..... 57/401; 57/91

[58] Field of Search ..... 57/58.89–58.95, 57/90, 91, 317, 318

[56] References Cited

U.S. PATENT DOCUMENTS

| | | | |
|---|---|---|---|
| 4,002,016 | 1/1977 | Fischer et al. | 57/58.95 |
| 4,070,811 | 1/1978 | Fehrer | 57/58.95 X |
| 4,107,909 | 8/1978 | Fehrer et al. | 57/58.95 X |
| 4,109,454 | 8/1978 | Fehrer et al. | 57/58.95 |
| 4,144,703 | 3/1979 | Ingham, Jr. | 57/58.89 |
| 4,160,359 | 7/1979 | Frentress | 57/58.89 |

*Primary Examiner*—John Petrakes

*Attorney, Agent, or Firm*—Beveridge, DeGrandi & Kline

[57] ABSTRACT

A method and an apparatus for the production of fancy yarn includes the supply of elongate fancy material pieces (17) by gas under pressure to suction-loaded spinning cylinders (10) which spin the fancy material pieces together with separately supplied basic yarn pieces to form fancy yarn. The fancy material pieces are flung by means of the gas under pressure, which is preferably generated in a jet injector (14), against a screen (7) which is located in the region of the nip between the spinning cylinders. Elongate fancy material pieces which have become rolled together during transport to the screen (7) are straightened out after impingement against the screen (7) by the suction prevailing in the nip of the spinning cylinders (10) whereby the fancy material pieces are given the desired elongate form in the fancy yarn.

10 Claims, 3 Drawing Figures

METHOD AND APPARATUS FOR THE PRODUCTION OF FANCY YARN

The present invention relates to a method and an apparatus for the production of fancy yarn.

The basic concept in a known method for the production of fancy yarn is that the fancy material is thrown into the nip between two rotating yarn spinning cylinders which spin the loose basic yarn twist, the fancy material being admixed to the basic yarn twist.

While this method is suited for the production of fancy yarn in which the fancy material serving to provide the finished yarn effect is of particulate or spheroid shape, it is not suited for the production of fancy yarn in which the fancy material is to have elongate form, since it has proved that such elongate fancy material pieces, on introduction to the cylinder nip, often roll up into balls and are fixed in this shape on being spun together with the basic twist, so that the finished fancy yarn displays unsightly knops of fancy material. Alternatively, the fancy material might not, on being spun together with the basic twist, be properly spun into the twist, with the result that the fancy material comes loose when the yarn is woven. Furthermore, it is difficult to realize a reproducible fancy yarn with this prior art method, that is to say a yarn in which the fancy material lies consistently in desired positions in the yarn.

SUMMARY OF THE INVENTION

For avoiding these disadvantages in the above-discussed known method, the present invention has realized a method and an apparatus which permit the production of fancy yarn with elongate fancy pieces in the basic yarn twist and which permit fancy yarn reproduction. Basic yarn material is formed into basic yarn twists in the nip between rotating spinning cylinders. The nip is subjected to a partial vacuum, and fancy material pieces are introduced into the nip in order to be included in the basic yarn twists. The fancy material pieces, within the region of the partial vacuum, are flung against a screen for further conveyance to the nip. The fancy material pieces can be elongate and can be flung against the screen by means of a jet injector which is supplied with the fancy material pieces by means of a suction conduit of the injector. The frequency, length and thickness of the fancy material pieces in the fancy yarn can be adjusted by means of a programming mechanism which is operative to influence the driving of fancy-material-drawing rollers which create the fancy material pieces.

The apparatus for carrying out the method of this invention includes two spinning cylinders for yarn spinning, means for causing a partial vacuum in the nip between the cylinders, and a means for supplying the basic yarn material to the nip. The apparatus further includes a screen in the proximity of the nip and a means for flinging, with the assistance of gas under pressure, the fancy material pieces against the screen. The means for flinging can consist of a jet injector having a suction conduit which supplies the fancy material pieces. The screen can consist of a surface on a guide plate which is disposed to guide, with its opposite surface, the basic yarn material to the nip. The apparatus can also include a programming mechanism which is operative to control the driving of rollers producing the fancy material pieces and connected to the flinging means, for determining the length, frequency and thickness of fancy material in the fancy yarn.

BRIEF DESCRIPTION OF THE DRAWINGS

The invention will be described in greater detail below with reference to the accompanying drawing.

DETAILED DESCRIPTION OF THE INVENTION

Figure 1:
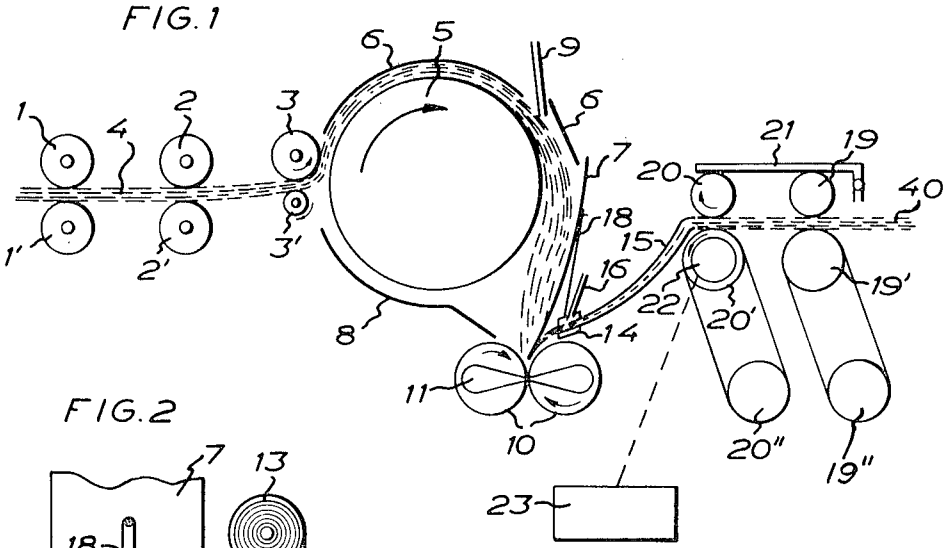
FIG. 1 is a schematic illustration of an apparatus according to the invention in an "open end" type spinning frame.
Figure 2:
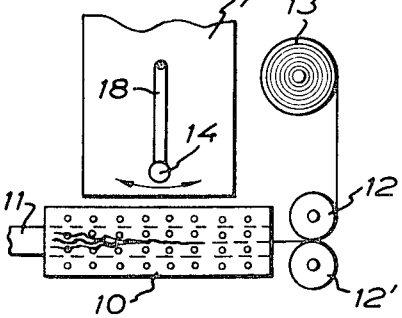
FIG. 2 schematically illustrates a screen with an injector at a yarn spinning cylinder.

FIG. 1 shows an "open end" machine (DREF) for yarn production together with an apparatus according to the invention for the production of fancy yarn. Pairs of licker-in rollers 1, 1', drawing rollers 2, 2' and supply rollers 3, 3' advance the card web 4 for yarn production to an opening cylinder 5 with saw tooth fittings (not shown) for loosening or opening the card web to discrete flocks or fibres which, by means of guide plates 6, 7, 8, and with the assistance of compressed air from a compressed air-supply conduit 9, are fed to the nip between two elongate spinning cylinders 10 which rotate in the same direction and which are provided with a perforated outer surface. Suction conduits 11 discharge into the cylinders 10 for orientation of the web or basic fibre material in the nip between the cylinders. In this nip, the oriented fibres and flocks are twisted to form yarn which is led out from the nip in the longitudinal direction of the cylinders by means of two discharge rollers 12, 12' (FIG. 2) to a yarn cop or bobbin 13.

For the introduction of an effect into the basic material such as material of the same colour as, or other colour than the basic material, the present invention calls for a fancy material-supply jet injector 14 directed towards a screen which, advantageously but not necessarily, may consist of the surface of the guide plate 7 facing away from the opener cylinder 5. The fancy material which consists of, for example, fancy material 40 dispersed to elongate pieces or flocks/fibres, is supplied to the injector by means of a conduit 15 under the action of suction from the injector, whose suction-creating pressure-gas hose is designated 16. Thus, the elongate fancy material pieces are thrown against the above-mentioned surface of the guide plate 7, the area of impingement being disposed substantially in the region of the suction effect from the suction conduits 11. The result of this arrangement is that the flocks and fibres 17 of the fancy material which arrive at the plate 7 in bundled or knopped state are, after impingement against the plate 7, substantially straightened out (FIG. 3) to their elongate form by the force from the suction from the nip between the cylinders 10 and arrive, in substantially straightened form, at the nip between the cylinders where they, still in the straightened condition, are twisted together with the basic yarn material emanating from the opener cylinder 5 and are conveyed, entwined together with the basic yarn twist to the discharge roller 12, 12' and the cop or bobbin 13.

Figure 3:
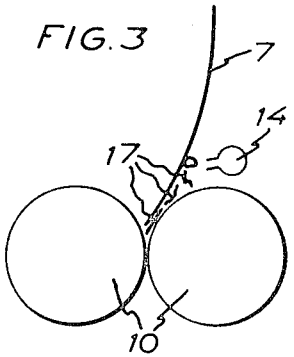
FIG. 3 illustrates the effect of the apparatus according to the invention on the fancy material.

The straightening out effect on the fancy material pieces after impingement against the plate 7 probably depends upon the instantaneous arrest experienced by the fancy material on impingement against the plate 7 so that the suction from the cylinder nip can make itself felt for the straightening-out operation (FIG. 3). In any event, it has not been possible to observe any straightening-out effect on the direct blowing-in of elongate fancy material into the suction-loaded nip between the spinning cylinders, the fancy material pieces being instead incorporated into the basic yarn twist in knops rather than straightening-out pieces.

Advantageously, the injector 14 is swingably disposed in the longitudinal direction of the spinning cylinders (FIG. 2) and, for example, pivoted on the plate 7 by means of a holder 18 so that it can supply the fancy material to the spinning cylinders at an optional position of the twist-imparting length of the cylinders via the plate 7. On supply of fancy material at the beginning of the twist-imparting length, the fancy material is mixed with the still quite loosely composed basic twist so that a mingled effect is obtained. On the other hand, on supply of the fancy material towards the end of the twist-imparting length, a core of basic yarn twist will be obtained surrounded by the fancy material which is bonded to the basic yarn twist by means of relatively few basic twist fibres so that the appearance of the fancy material is dominant at those places in the finished fancy yarn where the fancy material is located.

Two pairs of rollers 19, 19' and 20, 20' are provided for realizing elongate fancy material pieces for supply to the injector, the rollers in each pair being, by means of a pendulum arm 21, spring-loaded towards each other and the lower rollers 19' and 20', respectively, being driven by means of motors 19'' and 20''. The basic fancy material such as fancy ribbon or roving is added to the rear roller pair 19, 19' and drawn and divided into elongate pieces by means of the forward or drawing roller pair 20, 20'. The discrete fancy material pieces are caught by the suction conduit 15 of the injector for supply to the injector 14.

For optional distribution of the fancy material in the basic twist, the lower roller 20' in the forward roller pair 20, 20' is advantageously connected to its motor 20'' by the intermediary of a magnet switch 22 which receives current pulses from a programming mechanism operated by means of, for example, a magnetic tape or punched tape. The signals from the programming mechanism are operative to actuate the magnet switch and thereby to occasion driving of the rollers 20, 20' and—with the rollers 19, 19' in continual operation—to influence the length and frequency of the fancy material pieces. By variation of the ratio between the speeds of the rollers 19, 19' and 20, 20' (which may be realized by the utilization of motors whose speed may be stepwise or steplessly variable) the thickness of the fancy material pieces may also be varied.

It should be clear to the skilled reader that the apparatus according to the invention permits introduction into the basic twist of mutually different fancy materials, a desired number of programme-controlled fancy material-producing mechanisms being connected to the suction conduit 15 of the injector 14.

The method and apparatus according to the invention may also be utilized when the open end machine is provided with a "paradisc" set, a screen according to the invention being fixedly mounted substantially horizontally between the paradisc device (the rotary vane) and one of the spinning cylinders, the edge portion of this screen located close to the nip between the spinning cylinders being bent downwardly into the nip. The fancy material pieces are flung against the underface of the screen and, under the action of the suction in the cylinder nip, are guided by this underface into the nip.

I claim:

1. Method of producing fancy yarn, in which method basic yarn material is formed to basic yarn twist in the nip between rotating spinning cylinders, the nip being subjected to a partial vacuum, and fancy material pieces being introduced into the nip in order to be included in the basic yarn twist, wherein the fancy material pieces, within the region of said partial vacuum, are flung against a screen for further conveyance to the nip.

2. Method according to claim 1, wherein the fancy material pieces are elongate.

3. Method according to claim 1 or 2, wherein the fancy material pieces are flung against said screen by means of a jet injector which is supplied with said pieces by means of the suction conduit of the injector.

4. Method according to claim 3, wherein the frequency, length and thickness of the fancy material pieces in the fancy yarn and adjusted by means of a programming mechanism which is operative to influence the driving of fancy-material-drawing rollers which create the fancy material pieces.

5. Method according to any one of claims 1 or 2, wherein the frequency, length and thickness of the fancy material pieces in the fancy yarn are adjusted by means of a programming mechanism which is operative to influence the driving of fancy-material-drawing rollers which create the fancy material pieces.

6. Apparatus for producing fancy yarn comprising two spinning cylinders positioned together with a nip therebetween for yarn spinning, means for causing a partial vacuum in the nip between the cylinders, means for supplying basic yarn material to the nip, a screen in the proximity of the nip, a source of gas under pressure, and means for flinging, with the assistance of gas under pressure, fancy material pieces against the screen.

7. Apparatus according to claim 6, wherein said means for flinging consists of a jet injector with a suction conduit supplying the fancy material pieces.

8. Apparatus according to claim 6 or 7, wherein the screen consists of a guide plate having a first surface disposed to guide the basic yarn material to said nip and a second, opposite surface disposed to guide the fancy material pieces to said nip.

9. Apparatus according to claim 8, further comprising a programming mechanism and a pair of rollers, said rollers being adjacent to an incoming supply of fancy material, said programming mechanism being operative to control the driving of said rollers to produce the fancy material pieces and being connected to said flinging means for determining the length, frequency and thickness of fancy material in the fancy yarn.

10. Apparatus according to any one of claims 6 or 7 further comprising a programming mechanism and a pair of rollers, said rollers being adjacent to an incoming supply of fancy material, said programming mechanism being operative to control the driving of said rollers to produce the fancy material pieces and being connected to said flinging means for determining the length, frequency and thickness of fancy material in the fancy yarn.

* * * * *